United States Patent [19]

Lo

[11] Patent Number: 4,756,216

[45] Date of Patent: Jul. 12, 1988

[54] TURN-ON AND TURN-OFF CONTROL APPARATUS FOR ELECTRIC SCREW-DRIVERS

[75] Inventor: Juey Y. Lo, Yung Ho City, Taiwan

[73] Assignee: Top Driver Enterprise Co., Ltd., Yung Ho City, Taiwan

[21] Appl. No.: 116,315

[22] Filed: Nov. 4, 1987

Related U.S. Application Data

[63] Continuation-in-part of Ser. No. 881,364, Jul. 2, 1986, Pat. No. 4,712,456.

[51] Int. Cl.[4] ..... B25B 23/157

[52] U.S. Cl. ..... 81/473; 81/478; 173/12; 173/93.5

[58] Field of Search ..... 81/473, 478, 467, 469, 81/474, 479, 475, 480; 173/12, 93.5, 93, 93.7

[56] References Cited

U.S. PATENT DOCUMENTS 4,712,456 12/1987 Yuan ..... 81/473

*Primary Examiner*—Frederick R. Schmidt
*Assistant Examiner*—Maurina Rachuba
*Attorney, Agent, or Firm*—Sughrue, Mion, Zinn, Macpeak and Seas

[57] ABSTRACT

A turn-on and turn-off control apparatus for electric screw-drivers including: a disk seat member with a plurality of tabs and blocks for making connections therewith; an arresting mechanism retractably disposed in the blocks, a positioning device fixed on the tabs in opposite direction; a turn-on switch matched with a first follower member and a second follower member connected to the positioning device; a turn-off switch matched with a braking follower member movably arranged on one side of the positioning device; and a linking-up device movably connected between the positioning device and a clutch and driving mechanism of an electric screw-driver, which is installed in a body structure together with the turn-on and turn-off control apparatus; thereby, turn-on and turn-off of the electric screw-driver can be effectively performed in screw tightening and loosing operations.

8 Claims, 6 Drawing Sheets

60
602
601
701
702
70
600
700
40
401
410
311
400
312
604
313
350
310
603
35
31
502
322
500
50
312
30
321
323
800
500
32
501
320
12
33
802
801
80
101
11
110
12
10
100'
20
21
11'
110'
22
13
220
221
130
101
100'
100
34
222
92
24
910
911
23
912
91
913
90
914
915
91
913
915

915
949'
949"
943'
943"
990
991
91

TURN-ON AND TURN-OFF CONTROL APPARATUS FOR ELECTRIC SCREW-DRIVERS

BACKGROUND OF THE INVENTION

This application is a continuation-in-part of application Ser. No. 881,364 filed July 2, 1986 allowed on July 14, 1987, and now U.S. Pat. No. 4,712,456, patented on Dec. 15, 1987.

This invention relates to a turn-on and turn-off control apparatus for electric screw-drivers, and more particularly to that type of control apparatus suitable for various kinds of electric screw drivers driven by a clutch mechanism.

The known electric screw-drivers are usually provided with a turn-on device and a turn-off device both of which are separately constructed for performing individual operations. As shown in FIG. 1, a conventional circuit diagram designed for operating the known electric screw-drivers includes a triggering and conducting circuit 1 for the main power source, a rectifying circuit 2 for the power source of a motor, a turn-off inducting circuit and a turn-off operating circuit 3 and a power source circuit for the control system of the electric screw-driver. The control mechanism with two separate switches built on the above-mentioned circuit diagram is normally disposed in a mini-box for being carried along with the known electric screw-driver and used through an electrical connecting cord. Meanwhile, said control mechanism can also be installed in a head portion of the known electric screw-driver. However, owing to the structural limitation of the known electric screw-driver, said control mechanism with two separate switches has to be minimized and can be applied only to a low-current operation. On the other hand, if the transmission system of the known electric screw-driver is a clutch type, said control mechanism with two switches is always disposed adjacent to the clutch mechanism, causing a considerable difficulty in assembly and maintenance work. Because of the problems described above, not only is the manufacturing cost high but also the utilization of the known electric screw drivers is inconvenient.

SUMMARY OF THE INVENTION

It is accordingly a primary object of this invention to provide a turn-on and turn-off control apparatus for electric screw-drivers that overcomes the foregoing problems associated with the prior art.

This and other objects are achieved by providing a preferred embodiment of a turn-on and turn-off control apparatus, which comprises: a disk seat means having a plurality of tabs and blocks vertically located thereon for making connections therewith; an arresting mechanism retractably disposed between two opposing blocks on the disk seat means; positioning means with a set of positioning members respectively connected to the tabs in opposite direction on the disk seat means; a turn-on switching means matched with a first follower member and a second follower member connected to the positioning means on the disk seat means; a turn-off switching means coupled with a braking follower member disposed beside the turn-on switch on the disk seat means; and a linking-up means movably connected between one of the positioning members and a clutch and driving mechanism of an electric screw driver; thereby, turn-on and turn-off operations of the electric screw driver can be conveniently performed accordingly.

Other advantages and characteristics of the invention will be become clear from the following detailed description of a preferred embodiment when read in conjunction with the accompanying drawings.

BRIEF DESCRIPTION OF THE DRAWINGS

FIG. 2 (A) is an illustrative view indicating a changing condition of a regulating opening of a linking-up mechanism adopted in the preferred embodiment;

DETAILED DESCRIPTION OF THE PREFERRED EMBODIMENT

Figure 1:
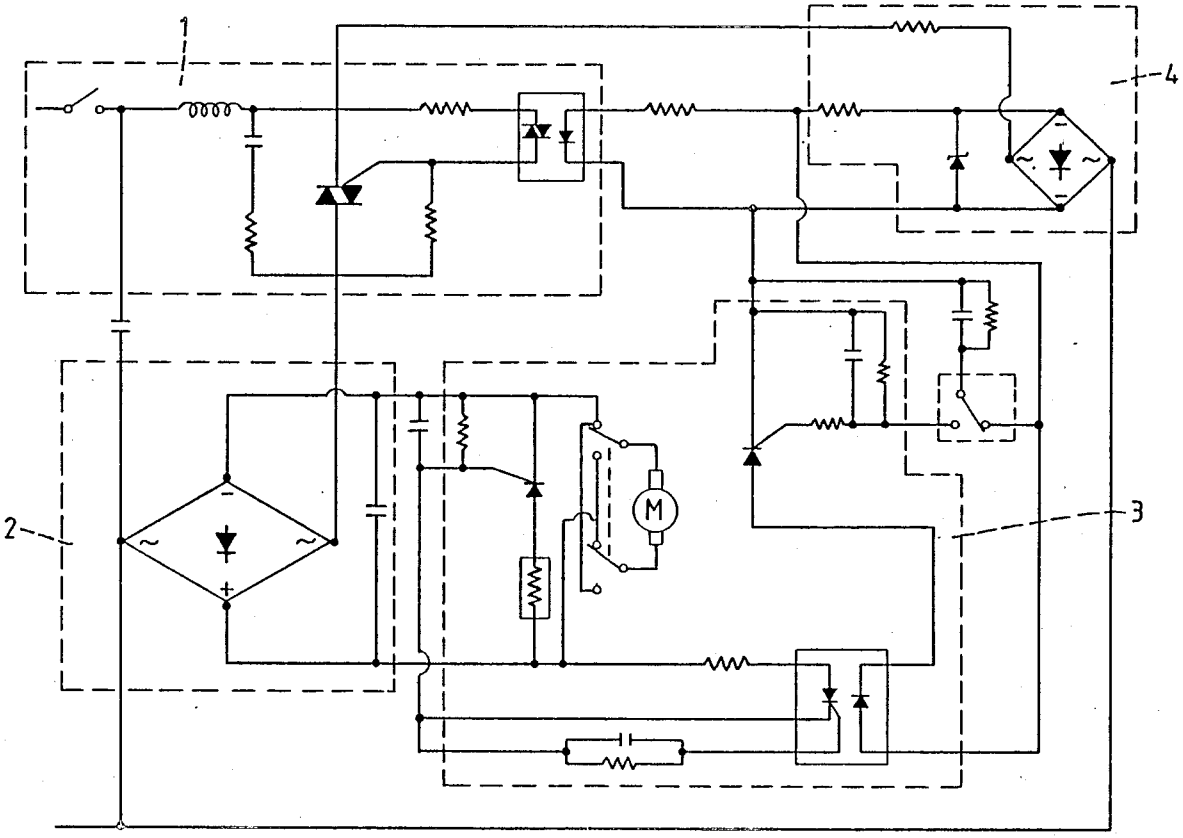
FIG. 1 is a circuit diagram of a turn-on and turn-off control mechanism for conventional electric screw-drivers.
Figures 2, 2A:
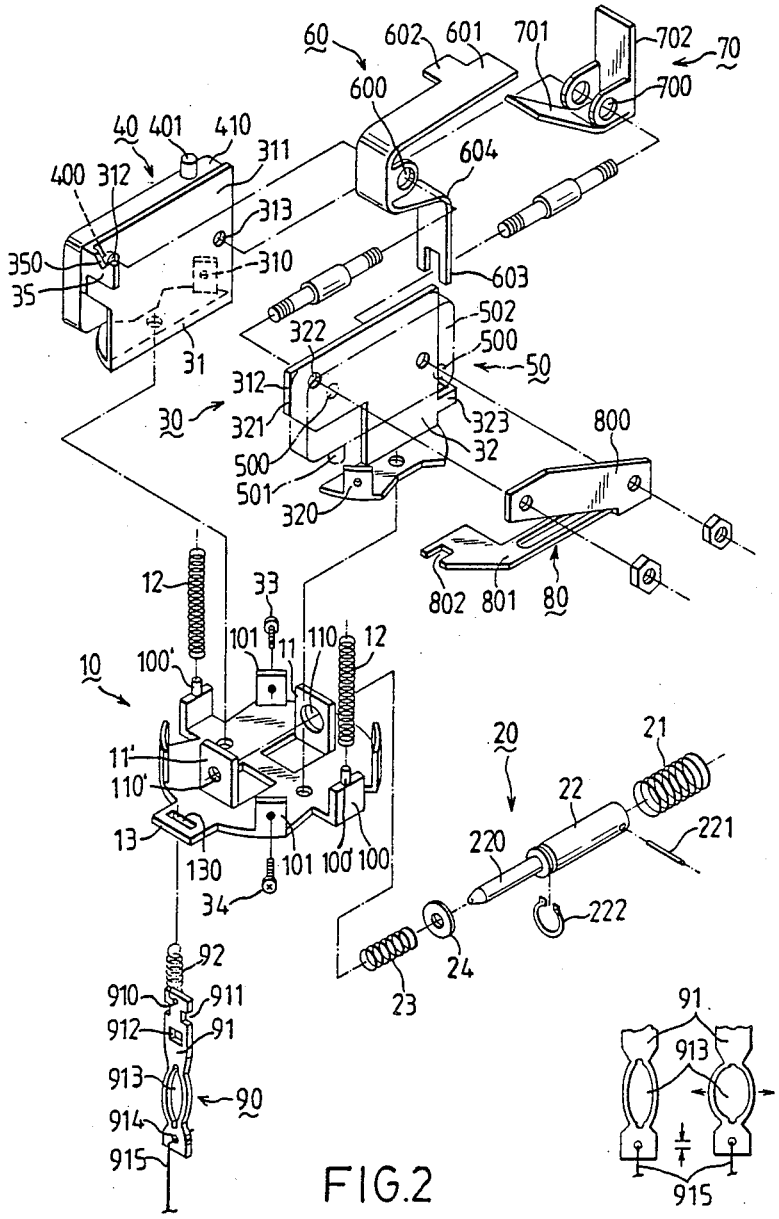
FIG. 2 is an explosive and perspective view of a turn-on and turn-off control apparatus for electric screw-drivers according to this invention.
Figure 3:
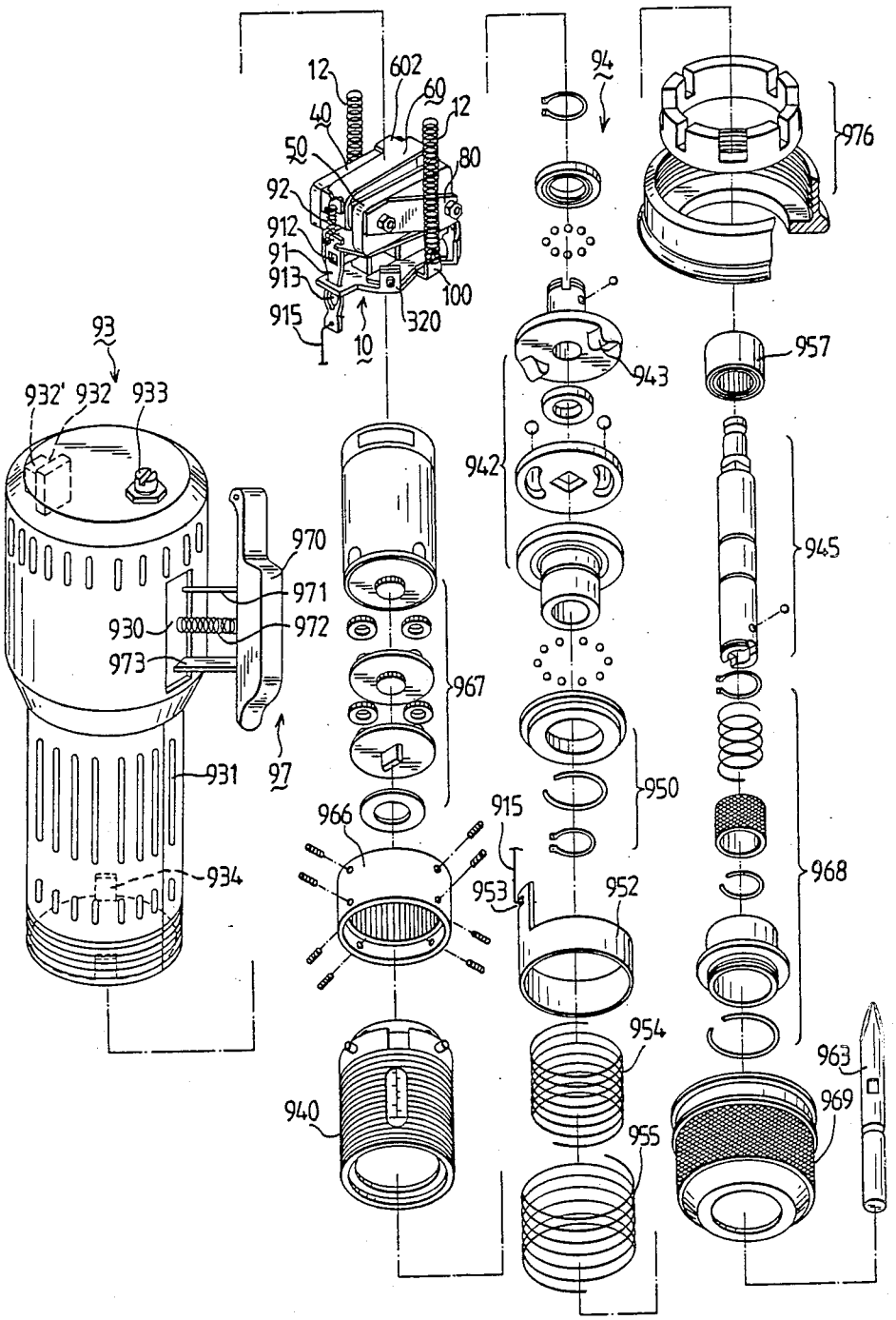
FIG. 3 is an explosive and perspective view of a known clutch-type electric screw-driver for being assembled wtih the preferred embodiment of FIG. 2 in combination.

Referring to FIGS. 2 and 3, the preferred embodiment of a turn-on and turn-off apparatus for electric screw-drivers according to this invention comprises in combination a disk member 10, an arresting mechanism 20, a positioning means 30, a turn-on switching means 40, a turn-off switching means 50, a first follower member 60, a second follower member 70, a braking follower member and a linking-up mechanism 90, together with a body structure 93 and a push button device 97.

Figure 4:
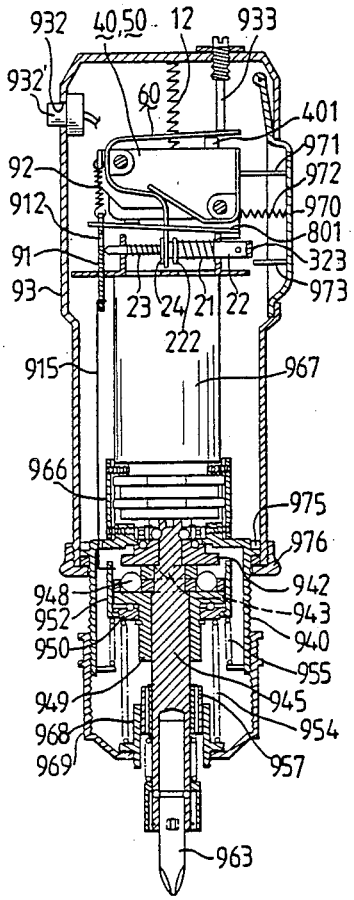
FIG. 4 is a partial sectional view of the assembled clutch-type electric screw-driver and the preferred embodiment shown in FIG. 3.

As shown in FIG. 2 with reference to FIG. 4, the disk seat member 10 comprises a plurality of tabs 100 and 101 vertically formed along the periphery, a pair of positioning blocks 11, 11' each having an opening 110, 110' provided therein symmetrically located in a middle area, a pair of return springs 12 with one end of each separately disposed on a holding stub 100' located on a top end of the opposing tabs 100 and the other end of each vertically extending therefrom, and a supporting lug 13 with a guide opening 130 at one side for connecting purpose.

The arresting mechanism 20 comprises: a brake rod 22 having a first spring 21 sleevingly arranged around a rear portion 200 being movably installed in the openings 110, 110' of the positioning blocks 11, 11' with a check pin 221 inserted into a pin hole 201 of the rear portion 200 against a rear side of the first positioning block 11; a retaining ring 222 fixed at a recess formed around a front end part of the rear portion 200 for being positioned to stop the front end of the first spring 21; a second spring 23 arranged around a front portion 220 of the brake rod with a stop nut 24 disposed at the front end of the second spring 23 and movably located around the rear end of the front portion 220 of which the free end movably extends out of the opening 110' of the positioning block 11'.

The positioning means 30 includes a first positioning member 31 and a second positioning member 32 both being formed in an L shape and having a first positioning lug 310 and a second positioning lugs 321 separately formed at each lower side thereof for being respectively connected to the positioning tabs 101 in opposite direction on the disk seat member 10 through a plurality of screws 33 and 34, and each one of the positioning members 31 and 32 having a plurality of locating openings 312, 313; 322, 323 respectively formed in a side wall 311, 321 thereof. In addition, a curved lug 35 with an open notch 350 in the middle thereof is integrally formed at an upper side of the first positioning member 31.

Figure 6B:
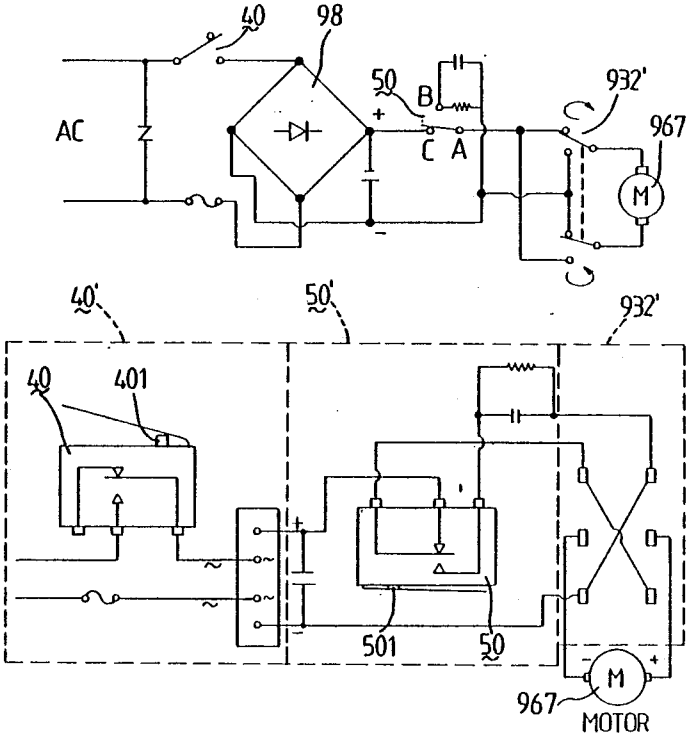
FIGS. 6(A) and 6(B) are circuit diagrams of the preferred embodiment of FIG. 2.
Figure 6A:
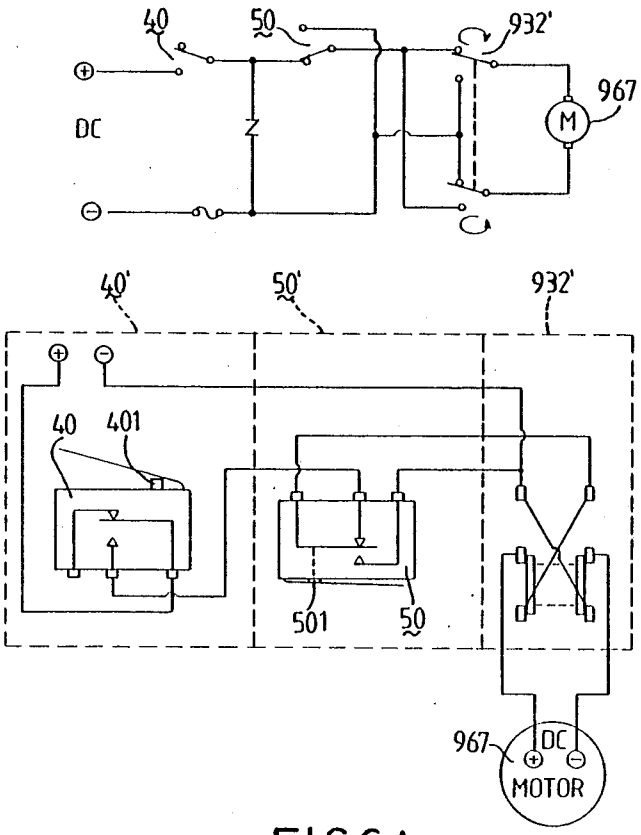

As shown in FIG. 2 with reference to FIGS. 6(A) and 6(B), the turn-on switching means 40, including a first body structure 410 having a plurality of locating orifices 400, 400' formed in side wall corresponding to the locating openings 312 and 313 of the first positioning member 31, a first circuit means 40', as shown in FIGS. 6A and 6B, disposed in the first body structure 410, and a first contact knob 401 movably provided on a top surface of the body structure 410 in conjunction with the circuit means for effecting making and braking of the circuit means therewith, is connected to the side wall 311 with the locating orifices 400, 400' separately aligned with the locating openings 312 and 313 of the first positioning member 31 and the contact knob 401 projecting upward at the top surface of the first body portion 410.

The turn-off switching means 50, which is combined of a second body structure 502 with a plurality of locating orifices 500, 500' formed in an upper wall thereof corresponding to the locating openings 322, 323 of the second positioning member 32, a second circuit means 50', as shown in FIGS. 6(A) and 6(B), arranged in the second body structure 502, and a second contact knob 501 on a bottom surface of the second body structure 510 in conjunction with the second circuit means so as to be turned on and off in accordance with the turn-on switch 40, is connected to the second positioning member 32 with the locating orifices 500, 500' separately aligned wtih the locating openings 322 and 323 and the contact knob 501 extending downward on the bottom surface of the body portion 510 for being operated to make and brake the turn-off switch circuit, which is in series-connection with that of the turn-on switch 40.

The first follower member 60 includes an arcuate-shaped body 610 with a pressing flange 602 formed at one side of a horizontal front end 601, a curvature 604 at a lower portion, a forked part 603 at a vertical lower end and a pivotal opening 600 in a middle area for being pivotally connected to the side walls 311 and 321 of the positioning members 31 and 32 with the pressing flange 602 located over the contact knob 401 of the turn-on switch 40 and the forked part 604 riding on the brake rod 22 between the retaining ring 222 and the stop nut 24.

The second follower member 70 is formed in a V shape with a front piece 702 and a rear piece 701 on both sides, and a pivot opening 700 in a middle area is movably coupled between the side walls 311, 321 of the positioning members 31 and 32 through the locating openings 313 and 323 with the rear piece 701 being kept in contact with the curvature 603 of the first follower member 60.

The braking follower member 80 is formed in a tortuous C shape, including a positioning side 800 being connected to the body portion 502 of the turn-off switch 50 through the locating orifices 500 and 500', and an elastic side level 801 with a fork end 802 thereat being located under the bottom side of the turn-off switch 50, wherein a curved part of the elastic side level 801 is directly located under the end of the contact knob 501 of the turn-off switch 50.

The linking-up mechanism 90 includes: a motion member 91 with a first link opening 910 at an upper end thereof, a notched portion 911 below the link opening 910, a braking opening 912 under the notched portion 911, a regulating slot 913, and a second link opening 914 in the lower end; a spring 92 having one end hooked in the first link opening 910 and the other end connected to the open notch 350 of the curved lug 35, as shown in FIG. 4, when the motion member 91 is slidingly disposed in the guide opening 130 of the disk seat member 10; and a motion linking line 915 fixed in the second link opening 914 at one end.

The assembled embodiment of the turn-on and turn-off control apparatus according to this invention is as shown in FIG. 3 for being disposed in a clutch-type electric screw-driver, which is combined of a body structure 93, a clutch mechanism 94 and a push-button device 97.

Referring to FIGS. 3 and 4, the body structure 93 is combined of two equal parts for being formed in a hollow cylindrical shape and includes: an elongated opening 930 located in an upper portion; a plurality of air gaps 931 in the lower portion; a switch opening 932 provided in an upper side having a reversing switch 932' installed therein; an adjusting rod 933 disposed in a top end for being operatively kept in contact with the first follower member 60 after the turn-on and turn-off control apparatus is installed in the body structure 93; and a locating block 934 vertically provided in the lower end.

The clutch mechanism 94 which is comprised of a bearing 941, a clutch and driving device 942, a driven shaft 945, a driven member 950, an annular linking-up member 952, and a pin bearing 957 disposed in a clutch boss 940, and which is combined with a screw-driver device 960, a motor 967 connected to a cylindrical internal gear 966, a torsion adjusting member 969 and a screw driver 963 matched with a torsion spring 954 and a buffer spring 955, is operatively disposed in the body structure 93, as shown in FIG. 4 (since the structure of clutch mechanism 94 is well known to those skilled in the art, detailed description of the configuration and assembly operation are hereby omitted for clarity), and fixed therein with a fast coupling member 976. The disk seat member 10 is operatively disposed over the top of the motor 967, wherein each upper end of the return springs 12 is vertically extending from the top of the opposing holding tubs 100, the lower end of the motion linking line 915 is hooked in an orifice 953 of the linking-up member 952 and the turn-on and turn-off switches 40 and 50 are respectively coupled with motor 967 through the reversing switch 932' (connection details are as shown in FIGS. 6A and 6B). The push button device 97 including a button member 970 with a push rod 971, a reverse spring 972 and a restraining piece 973 respectively disposed on an inverse side thereof is movably provided against the turn-on and turn-off control apparatus.

After the combination of the turn-on and turn-off control apparatus and the clutch mechanism 94, the two equal parts of the body structure 93 are coupled together and fastened with a fast coupling member 976 and a torsion adjusting member 969 around the lower end of the body structure 93 with the push button member 970 movably positioned in the elongated opening 930 having the other end of the reverse spring 972 abutted on the front sied of the positioning means 30, the restraining piece 973 located beside and above the disk seat member 10, and the upper ends of the two return springs 12 compressively abutting upon the inner top surface of the body structure 93.

Figure 5A:
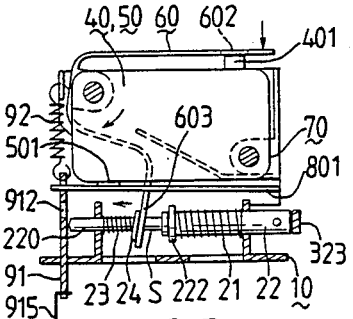
FIGS. 5(A), 5(B) and 5(C) are illustrations indicating operational conditions of the preferred embodiment shown in FIG. 2.
Figure 5B:
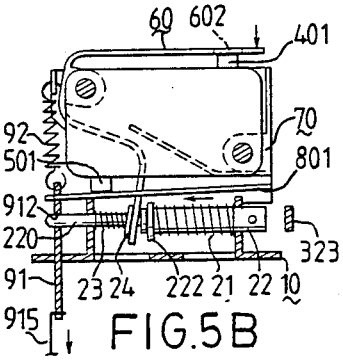

Referring to FIGS. 4, 5(A), 5(B), and 6(A), operations of the preferred embodiment of the turn-on and turn-off control apparatus according to this invention are as follows:

Holding the body structure 93 in hand and positioning the tip of the screw-driver 963 on a working screw (not shown), by pressing down the body structure 93 against the working screw, the adjusting rod 933 will be pushed down to press the first follower member 60, of which the pressing flange 602, in turn, will press the contact knob 401 downward thereform, causing the circuit of the turn-on switch 40 to close and resulting in starting the motor 967 to run together with the clutch and driving device 942 of the clutch mechanism 94. Consequently, the driven shaft 945 and the screw-driver 963 positioned on the working screw rotate along with the clutch and driving device 942. Meanwhile, at the time the follower member 60 is pressed down, its forked part 603 will move forward against the stop nut 24 and push the second spring 23 along the front portion 220 of the brake rod 22 with an interval S, as shown in FIG. 5A, left thereat and an expansion force being applied to the brake rod 22 to push it forward by both the first spring 21 and the second spring 23. When the working screw is turned and tightened, the driven shaft 945 stops rotating but the clutch and driving device 942 is kept running, enforcing the linking-up member 952 to move downward with the braking opening 912 of the motion linking line 915 shifted to a position facing the tip of the front portion 220 of the brake rod 22. In this condition the expansion force applied to the brake rod 22 by the first and second springs 21 and 23 will push the brake rod 22 forward with the tip of the front portion 220 being inserted into the braking opening 912 of the motion member 91 as shown in FIG. 5(B). In the meantime, simce the braking follower member 80 is also forced to move downward along with the motion member 91, the forked end 802 of the braking follower member 80 will be released from the bottom side of the contact knob 501 of the turn-off switch 50 so that the circuit of the turn-off switch 50 is cut off thereat (it shall be appreciated that with the contact knob 501 being urged by the braking follower member 80, as shown in FIG. 6(A), the circuit of the turn-off switch 50 is closed to conduction while with the contact knob 501 being released, the circuit of the turn-off switch 50 is open, therefore stopping the clutch and driving device 942 as well as the motor 967 from running. It is to be noted that the arrangement of the linking-up mechanism 90 and the arresting mechanism 20 is designed to effect braking operation immediately upon the motion member 91 being moved down by the linking-up member 952 along with the downward movement of the clutch and driving device 942; otherwise, the linking-up member 952 will be pulled upward again by the returning force of the spring 92, and the clutch and driving device 942 will continue to run thereat because when the driven shaft 945 ceases rotating, the linking-up member 952 will be pulled down and up again with every 180-degree turn of the rotation made by the clutch and driving device 942. Moreover, whenever the linking-up member 952 is pulled up, the braking follower member 80 will also be moved upward with its forked end 802 being forced to urge the contact knob 501 of the turn-off switch 50 to be closed thereat, causing the motor 961 to run again. In this condition, with each 360-degree turn made by the clutch and driving device 942, the linking-up member 952 will be caused to move up and down twice, resulting in the intermittent stop and go operation of the motor 967.

When the pressure applied on the body structure 93 is released upon the stop of the clutch mechanism 94, the expansion force of the return springs 12 will push the upper portion of the body structure 93 upward together with the adjusting rod 933. As a result, the first follower member 60 and the brake rod 22 will be propelled back to the original position under the expansion force of the return springs 12, and, in the meantime, upon the retraction of the brake rod 22 from the braking opening 912, the motion member 91 is also pulled upward by the spring 92 to the original position for the next operation.

Figure 5C:
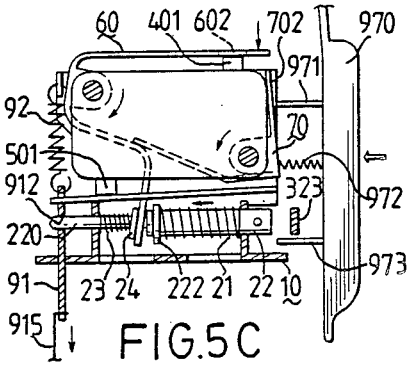

Referring to FIGS. 2, 4 and 5(C), instead of pressing the upper portion of the body structure 93, operations of the preferred embodiment can also be performed by pressing the button member 970 of the push button device 97. As shown, when the button member 970 is pressed down, the front tip of the push rod 971 will push the front piece 702 of the second follower member 70 of which the rear piece 701, in turn, will press the curvature 603 of the first follower 60 downward therefrom. As a result, the pressing flange 602 of the first follower 60 will press down the contact knob 401 of the turn-on switch 40 to start the motor 967. The starting and stopping operations of the clutch and driving device 942 and the turn-off switch 50 are the same as that described and illustrated in the above paragraphs. It shall be noted that when the button member 970 is pressed down, its restraining piece 973 is extended over the disk seat member 10 so as to prevent the upper portion of the body structure 93 from being pressed down. Thus, operations of the preferred embodiment according to this invention can be made either by pressing down the head of the body structure 93 or by manipulating the push button device 97 without incurring any interference.

It is to be noted that, as shown in FIG. 2 (A), the width of the regulating opening 913 can be increased or reduced in keeping with the up and down movement of the motion member 91. When the regulating opening 913 is expanded, the motion linking line 915 will be slightly moved up while, when the regulating opening 913 is narrowed, the motion linking line 915 will be slightly moved down. This regulating effect can enable the braking follower member 80 to adjust the contact distance between the side level 801 of the second follower member 80 and the contact knob 501 of the turn-off switch 50.

Referring to FIGS. 6(A) and 6(B), it shall be appreciated that the circuit arrangement of the turn-on switch 40 and the turn-off switch 50 for the preferred embodiment is greatly simplified by adopting either a DC circuit as shown in FIG. 6(A) or an AC circuit as shown in FIG. 6(B). Operations of both circuits are the same as that described hereinbefore. In addition, the reversing switch 932' is, as usual, used to control the turning direction of the motor 967 for performing screw tightening and loosing operations. Since this configuration of the reversing switch 932' is well known to those skilled in the art, detailed description is therefore omitted for brevity. Moreover, owing to the fact that the braking control operation is governed by the downward disposition of the motion member 91, the preferred embodiment of the turn-on and turn-off control apparatus according to this invention can be adapted to any electric screw driver combined with a clutch driving mechanism. Examples are as follows:

Shown in FIGS. 7 (A) and (B) is a type of a clutch driving mechanism having a plurality of right-angle driving flanges 943' coupled with the driven disk member 949' so that by the irregular rotating movement of the right-angle driving flanges 943', the driven disk member 949' will be compelled to pull down the motion linking line 915 in performing the same operation as that performed by the clutch and driving device 942 described and illustrated hereinbefore.

Shown in FIGS. 7(C) to 7(G) are other types of clutch driving mechanisms, each having a plurality of arc-shape driving flanges 943" coupled with the driven disk member 949'. By the arc movement of the driving flange 943", the driven disk member 949' will be moved to pull down the motion linking line 915 in effecting the same braking operation as that performed by the clutch and driving device 942 described above.

Figures 7A, 7B, 7C, 7D, 7E, 7F, 7G, 7H, 7I:
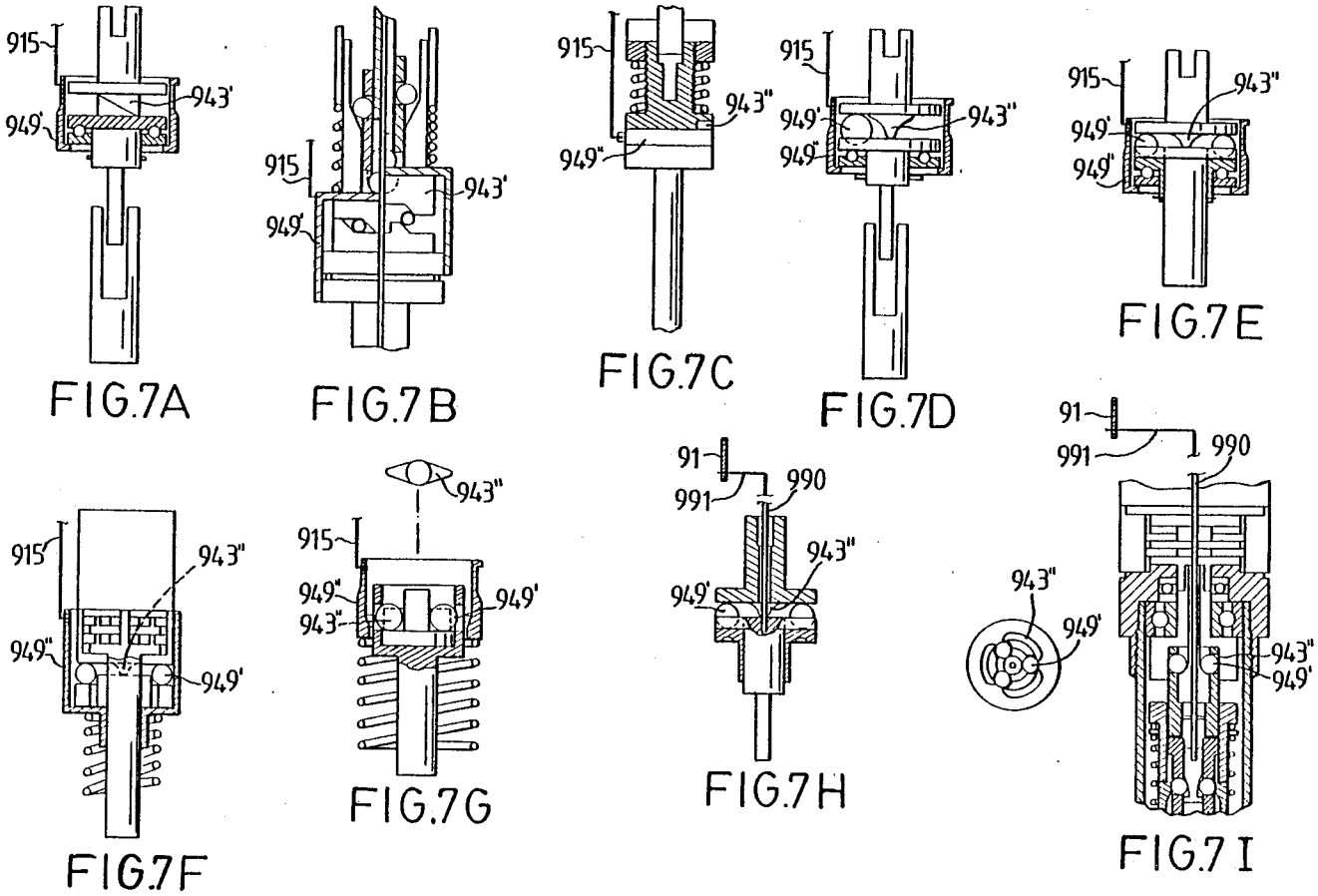
FIGS. 7(A), (B), (C), (D), (E), (F), (G), (H), and (I) are illustrations indicating various kinds of clutch mechanisms being applicable to the preferred embodiment of FIG. 2.

Shown in FIGS. 7(H) and (I) are other types of clutch driving mechanisms also having an arc-shape driving flange 943" coupled with the driven disk member 949". What is unlike the above-mentioned clutch driving mechanisms is that the motion member 91 is connected to a central shaft 900 of the clutch driving mechanism 943" through a transverse bar 991 so as to effect braking operation through the down-pull movement of the central shaft 990.

While a preferred embodiment has been chosen to illustrate the invention, it will be understood by those skilled in the art that various changes and modifications can be made therein without departing from the scope of the invention as defined in the appended claims.

What is claimed is:

1. A turn-on and turn-off control apparatus for electric screw-drivers having a combined hollow body structure with an elongated opening formed in an upper portion, a motor installed in a middle portion, a clutch and driving mechanism matched with a screw driver disposed in a lower portion and mechanically connected to the motor, a reversing switch electrically coupled with the motor, and an adjusting rod adjustably arranged in a top side of the body structure, comprising:

a disk seat means having a plurality of tabs vertically formed along a periphery thereof, at least two positioning blocks each with an opening symmetrically located on a middle area, and a supporting lug with a guide opening formed at one side for being mounted on top of the motor;

an arresting means retractably disposed in the openings of said positioning blocks for effecting braking operations;

positioning means fixed on said tabs in opposite directions on said disk seat means for providing connecting arrangement therewith;

a turn-on switching means connected to said positioning means in conjunction with the adjusting rod of the body structure and electrically coupled with the reversing switch for being actuated to start the motor in screw driving operations;

a turn-off switching means connected to said positioning means and electrically coupled with said turn-on switching and the reversing switch for turning off the motor in screw driving operations;

a push button means installed in the elongated opening of the body structure in conjunction with said turn-on switching means for actuating screw driving operation therewith; and a linking-up means elastically connected between said positioning means and the clutch and driving mechanism in conjunction with said arresting means for effecting braking operations therewith; whereby, turn-on and turn-off of electrical screw driving operations can be conveniently performed either by pressing down the upper portion of the body structure or by manipulating said push button means.

2. A turn-on and turn-off control apparatus according to claim 1 wherein said disk seat means further comprises a plurality of return springs each with one end being disposed on a holding stub located on each top end of said tabs and another end abutting upon a top reverse side of the body structure so as to enable the top portion of the body structure to be recovered upon a pressing-down pressure being released therefrom.

3. A turn-on and turn-off control apparatus according to claim 1 wherein said arresting means comprises:

a brake rod with a rear portion and a front portion having a pin hole located in the rear portion for being retractably installed in the openings of said positioning blocks of said disk seat means;

a check pin disposed in the pin hole of said brake rod against a rear side of one of said positioning blocks for checking the movement of said brake rod thereat;

a first elastic means matched with a retaining member arranged around said rear portion located between said positioning blocks for movement governing operations of said brake rod; and a second elastic means matched with a stop member movably disposed around said front portion for movement governing operations of said brake rod in conjunction with said first elastic means.

4. A turn-on and turn-off control apparatus according to claim 1 wherein said positioning means comprises:

a first positioning member formed in an L shape with a first positioning lug at a lower end and a plurality of locating openings provided in a side wall thereof being screw-connected to one of the tabs on said disk seat means; and a second positioning member formed in an L shape with a second positioning lug at a lower end, a curved lug with an open notch formed at an upper side, and a plurality of locating openings provided in a side wall thereof being screw-connected to another one of said tabs on said disk seat means and situated in opposite direction to said first positioning member so as to facilitate connection operations therewith.

5. A turn-on and turn-off control apparatus according to claim 1 wherein said turn-on switching means comprises: a first body structure with a side wall and a plurality of locating orifices formed therein corresponding to the locating openings of said first positioning member and connected therewith;

a first circuit means disposed in said body structure for being electrically connected to the reversing switch for effecting power supply operations;

a first contact knob movably provided on top of the side wall in conjunction with said first circuit means for effecting circuit making and breaking operations therewith;

a first follower member formed in an arcuate shape with a pressing flange at one side of a horizontal front end, a pivotal opening in a middle area, a curvature at a lower portion and fork part at a vertical lower end, and being pivotally connected to the side wall of said first positioning member through said pivot opening and one of the locating openings at an upper corner of said first positioning member with said pressing flange of said first follower member being located above said first contact knob of said turn-on switching means and below the adjusting rod of the first body structure, and the fork part movably riding on the front portion of said brake rod so as to effect movement of said arresting means; and a second follower member formed in a V shape with a front piece, a lower piece and a pivot opening in a middle portion pivotally connected to said first positioning member through said pivot opening and the other locating opening at a lower side of said first positioning member with the lower piece of said second follower member being kept in contact with the curvature of said first follower member for effecting pushing movement against said first follower member in turning-on the clutch and driving mechanism therewith.

6. A turn-on and turn-off control apparatus according to claim 1 wherein said turn-off switching means comprises:

a second body structure with a plurality of locating orifices formed in an upper wall thereof corresponding to said locating openings of said second positioning member and connected therewith;

a second circuit means disposed in said second body structure for being connected in series with the first circuit means of said turn-on switching means and the reversing switch, which is electrically coupled with the motor;

a second contact knob movably provided on a bottom side of the second body structure for being operatively made to connect and disconnect with said second circuit means in conjunction with said turn-on switching means; and a braking follower member formed in a tortuous C shape having a positioning side connected to said second body structure through the locating orifices thereof, and an elastic side level with a fork end thereat being abutted upon a button side of said second body structure with a curved part of said elastic side level being directly located under a lower end of said second contact knob for being operated to engage and disengage with said second contact knob in performing braking operation therewith.

7. A turn-on and turn-off control apparatus according to claim 1 wherein said linking-up means comprises:

a motion member with a first link opening at an upper end, a regulating slot in a middle area, a second link opening in a lower end;

an elastic means having one end connected to said first link opening of said motion member and the other end fixed on the open notch of the curved lug of said first positioning member for producing returning force thereat; and a motion linking-line with one end connected to said second link opening of said motion member and the other end fixed on a linking-up member of the clutch and driving mechanism; thereby, said motion member can be moved up and down in front of the brake rod of said arresting means for effecting braking operation therewith.

8. A turn-on and turn-off control apparatus according to claim 1 wherein said push button means comprises:

a button member movably installed in an elongated opening of the body structure;

a push rod provided on a reverse side of said button member for pushing the front piece of said second follower member upon said button member being pressed down;

a reverse spring with one end fixed on the reverse side of said button member and the other end abutting upon a front side of said positioning means so as to enable said button member to recover from a pressed down position therefrom; and a restraining member provided on the reverse side of said button member with a free end located beside and above said disk seat member for preventing the body structure from being pressed down when said button member is pushed downward in screw driving operation.

* * * * *